US005693907A

United States Patent [19]

Rudnik

[11] Patent Number: 5,693,907

[45] Date of Patent: Dec. 2, 1997

[54] MISSILE SUBASSEMBLY HAVING A COVERING BODY TRANSPARENT TO RADIATION AND A HOLDING RING

[75] Inventor: Hans-Joachim Rudnik, Constance, Germany

[73] Assignee: Bodenseewerk Gerätetechnik GmbH, Überlingen, Germany

[21] Appl. No.: 129,432

[22] Filed: Nov. 13, 1987

[30] Foreign Application Priority Data

Nov. 13, 1986 [DE] Germany ..... 36 38 847.5

[51] Int. Cl.[6] ..... F42B 15/34

[52] U.S. Cl. ..... 102/293; 244/3.16

[58] Field of Search ..... 102/200, 213, 102/293; 244/3.16

[56] References Cited

U.S. PATENT DOCUMENTS 2,997,594 8/1961 MacNeille ..... 244/3.16

3,111,088 11/1963 Fisk ..... 244/3.16

4,039,246 8/1977 Voigt ..... 244/3.16

OTHER PUBLICATIONS

Fugen Von Nichtmetallisierter Keramik Mit Metall Durch Einsatz Duktiler Aktivlote, by E. Lugscheider et al., Second International Colloquium in Bad Nauheim, pp. 199–211, Mar. 1985.

*Primary Examiner*—Charles T. Jordan

*Attorney, Agent, or Firm*—Keck, Mahin & Cate

[57] ABSTRACT

A dome subassembly (10) for missiles consists of a dome (12) and a holding ring (14) connected thereto, The dome (12) is made of sapphire. The holding ring (14) is made of oxide ceramics reinforced by fibre or whisker. Dome (12) and holding ring (14) are connected to each other by brazing. Two brazing methods are indicated.

10 Claims, 1 Drawing Sheet

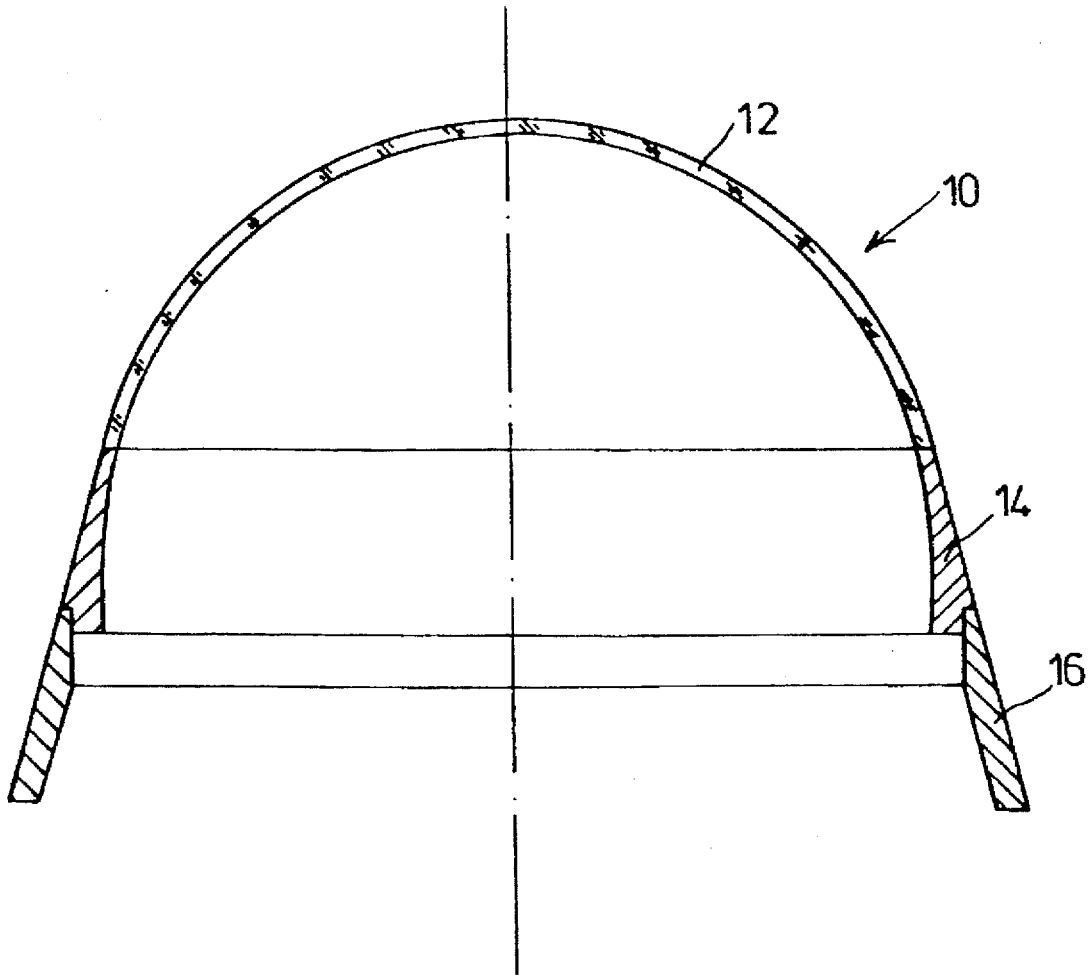
12
10
14
16

MISSILE SUBASSEMBLY HAVING A COVERING BODY TRANSPARENT TO RADIATION AND A HOLDING RING

The invention relates to a missile subassembly consisting of a covering body (dome or window) transparent to infrared radiation and a holding ring of ceramics connected thereto.

Missiles having a seeker responding to infrared radiation are known. Such a seeker is located in the nose of the missile. It is covered by a cupola-shaped covering body, the dome, transparent to infrared radiation and closing the nose of the missile. The dome is connected to a hoding ring. The holding ring on his side is connected to the rest of the missile structure.

The dome must transmit the infrared radiation emitted by a target with a transmission as high as possible to the seeker. This requires certain optical characteristics. On the other hand, the dome must protect the seeker against the occuring mechanical, thermal and chemical loads and stresses, and must itself withstand such loads and stresses. The material of the dome must be selected correspondingly. Known materials for the dome are magnesium fluoride, silicon, zinc sulphide, zinc selenite, sapphire or glass. The holding ring may be made in conventional missiles of metal, plastics or ceramics. The dome and the holding ring are connected by cementing.

The known missile subassemblies of this type having a holding ring of ceramics and a cementing connection between holding ring and dome, are not sufficient for high speed missiles in which the missile subassembly consisting of dome and holding ring is heated aerokinetically. Then high requirements are made with respect to the thermal stability of this missile subassembly:

The missile subassembly must withstand 1000 heatings from a subassembly temperature of 100° C. to 200° C. The temperature rate is 150 K/min. The holding time is five minutes.

The missile subassembly must withstand a temperature of 400° C. for the duration of one minute.

The missile subassembly must withstand a temperature of 600° C. for the duration of five secondes. The temperature rate is 200 K/s.

The following problems arise from these requirements:

The materials to be connected must be sufficiently matched with regard to their thermal dilatation behaviour. This is not the case in known constructions to an extent required for high speed missiles. Thereby tensions arise during the heating and cooling down, repectively, of the missile subassembly comprising the dome, these tensions having either to be dissipated in the junction zone or remain in the dome.

In the first case no proven junction method is known, which on one hand permits dissipation of the tensions in the junction zone, and which on the other hand meets the other mechanical requirements made to the connection between dome and holding ring. In the second case the superposition of these tensions by additional loads and stresses can exceed the admissible stability values of the dome material.

When using relatively well matched materials, for example a holding ring of ceramics with a dome of sapphire, the holding ring of ceramics would be destroyed by the temperature shock in case of the above indicated temperature loads and stresses.

It is the object of the invention to provide a missile assembly with dome (or other covering body) and holding ring which are appropriate for high speed missiles.

According to the invention this object is achieved in that (a) the holding ring is formed by ceramics reinforced by additions, and (b) the covering body is connected to the holding ring by brazing.

The ceramics reinforced by additions (fibres) can be optimized for the respective application with regard to their mechanical and thermal behaviour. Furthermore, the known disadavantages of the oxide ceramics, as for example low pressure toughness and low resistance to temperature shocks, are considerably reduced. Thus the occuring tensions caused by temperature are reduced and, thereby, the risk of overload of the dome material is prevented. Then a connection by brazing can be made, which does not permit dissipation of tensions in the junction zone, but which withstands the loads occuring with high speed missiles.

An embodiment of the invention will now be described in greater detail with reference to the accompanying drawing, which shows in longitudinal section a missile subassembly with dome and holding ring and their attachment to the missile structure.

The missile subassembly 10 consists of a covering body in the form of a dome 12 transparent to infrared radiation, and of a holding ring 14 connected thereto. The holding ring 14 is attached to the missile structure 16.

The covering body or dome 12 is made of sapphire. The holding ring 14 consists of ceramics reinforced by additives. In the preferred embodiment the ceramics are oxide ceramics which are fibre or whisker reinforced. The ceramics are preferably reinforced by silicon carbide fibre or by aluminum oxide fibres; ($Al_2O_3$).

The dome 12 is connected to the holding ring 14 by brazing.

For this purpose, there exist two possibilities.

In one type of brazing connection usable herein, one layer each of a metallizable material is sintered on the covering body 12 and on the holding ring 14 in the area of the surfaces to be connected. In the described embodiment the sintered layer is a molybdenum layer. These sintered layers are then metallized, for example nickel coated. The surfaces thus obtained having metallized layers are brazed to each other. With the metallization, brazings may be made up to 1200° C. under hydrogen atmosphere or in vacuum.

Another possibility consists in brazing the dome 12 and the holding ring 14 by an "active brazing agent". Active brazing agents are brazing agents which wet non-metallic materials such as ceramics or sapphire, and which thus permit a connection between two such materials or between one non metallic material and a metal. The boundary layer reaction required for the wetting is achieved by so called reactive alloy elements as Ti or Hf.

Fiber reinforced ceramics are known per se.

Active brazing agents are described in an publication entitled "Fügen von nichtmetallischer Keramik mit Metall durch Einsatz duktiler Aktivlote" by Lugscheider, Krappitz and Mizuhara, presented and published at the 2nd International Colloquium in Bad Nauheim, 27.-29.3.1985.

Instead of a dome also another window may be provided as covering body for certain applications.

I claim:

1. Missile subassembly consisting of a covering body (dome or window) transparent for infrared radiation and a holding ring of ceramics connected thereto, characterized in that (a) the holding ring (14) is formed by ceramics reinforced by additions, and (b) the covering body (12) is connected to the holding ring by brazing.

2. Missile subassembly as set forth in claim 1, characterized in that (a) one layer each of a metallizable material is sintered on the covering body (12) and on the holding ring (14) in the areas of the surfaces to be connected, (b) the sintered layers are metallized, and (c) the surfaces having the metallized layers are brazed tip each other.

3. Missile subassembly as set forth in claim 1, characterized in that the covering body (12) and the holding ring (14) are brazed to each other by an active brazing agent.

4. Missile subassembly as set forth in claim 1, characterized in that the covering body (12) is made of sapphire.

5. Missile subassembly as set forth in claim 1, characterized in that the ceramics of the holding ring (14) are oxide ceramics.

6. Missile subassembly as set forth in claim 5, characterized in that the ceramics are fibre reinforced.

7. Missile subassembly as set forth in claim 5, characterized in that the ceramics are whisker reinforced.

8. Missile subassembly as set forth in claim 6, characterized in that the ceramics are reinforced by silicon carbide fibres.

9. Missile subassembly as set forth in claim 6, characterized in that the ceramics are reinforced by aluminum oxide fibres ($Al_2O_3$).

10. Missile subassembly as set forth in claim 2, characterized that the sintered layer is a molybdenum layer.

* * * * *